United States Patent [19]

Gijrath

[11] 3,935,496

[45] Jan. 27, 1976

[54] STRUCTURE FOR ATTACHING CONICAL SHIELD TO SHADOW MASK

[75] Inventor: Johannes Henricus Nicolaas Gijrath, Eindhoven, Netherlands

[73] Assignee: U.S. Philips Corporation, New York, N.Y.

[22] Filed: Nov. 7, 1974

[21] Appl. No.: 521,586

[30] Foreign Application Priority Data

Nov. 30, 1973 Netherlands ..... 7316388

[52] U.S. Cl. ..... 313/402; 313/456

[51] Int. Cl.[2] ..... H01J 29/07; H01J 31/20

[58] Field of Search ..... 313/402, 404, 406, 407, 313/405

[56] References Cited

UNITED STATES PATENTS

| | | | |
|---|---|---|---|
| 3,548,235 | 12/1970 | Driedijk et al. | 313/404 |
| 3,821,583 | 6/1974 | Steiner | 313/407 |

*Primary Examiner*—Robert Segal

*Attorney, Agent, or Firm*—Frank R. Trifari; George B. Berka

[57] ABSTRACT

In a color cathode-ray tube, the color selection electrode is secured to the envelope, without the use of a rigid supporting frame, by resilient clamping members to which also the magnetic screening cone is secured.

5 Claims, 3 Drawing Figures

STRUCTURE FOR ATTACHING CONICAL SHIELD TO SHADOW MASK

Figure 1:
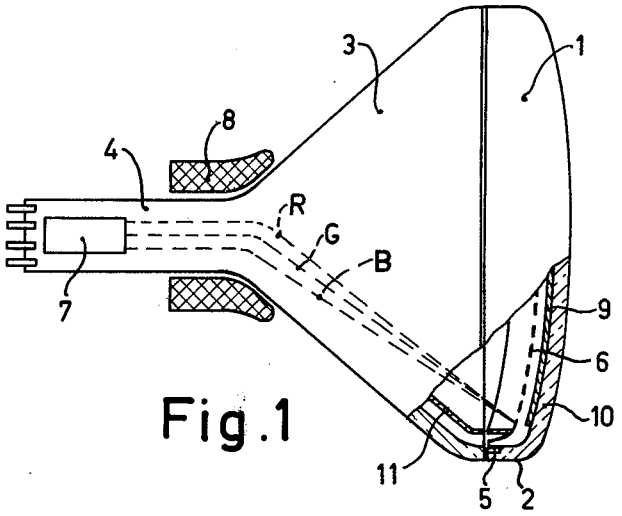

The invention relates to a cathode-ray tube for displaying colored pictures the evacuated envelope of which is formed partly by a cup-shaped mainly rectangular display window having in the upright edge thereof means to support a mainly rectangular color selection electrode which is suspended in the tube and comprises a number of suspension members which each comprise at their ends not connected to the electrode, a clamping member manufactured from a resilient material, which clamping member, in co-operation with the said supporting means, constitutes a detachable clamping connection, which tube furthermore comprises means for producing at least one electron beam, which electron beam is screened from the earth's magnetic field by means of a screening cone mounted in the tube and consisting of a ferromagnetic material.

In a cathode-ray tube for displaying colored pictures the color selection electrode usually consists of a thin perforated plate which is mounted in the tube at a short distance from the display screen and mainly parallel thereto. In order to give the electrode some rigidity, it is mounted in a rigid supporting frame having an L-shaped cross-section. A drawback of such a supporting frame is that during the warming-up period of the tube the thermal expansion of the supporting frame lags behind with respect to that of the perforated plate, as a result of which the apertures in the plate no longer correlate to the associated luminescent regions on the display screen.

A cathode-ray tube for displaying colored pictures is known from the U.S. Pat. No. 3,548,235 in which the color selection electrode is mounted in the tube without the use of a rigid supporting frame. In the construction described in the said patent specification, the comparatively larger rigidity which the color selection electrode has near its corners is used by securing the suspension members at the corners of the electrode. With such a connection, tilting of the colour selection electrode about its connection points is also avoided. In this construction the rigid supporting frame has been replaced by a ring which is also manufactured from thin sheet material and has an L-shaped cross-section and which serves as a screen for overscanned electron beams. A problem involved, however, is the connection of the internal magnetic screening cone. In the usual constructions with the above-mentioned rigid supporting frame, said supporting frame also serves to support and connect the screening cone. This is no ideal construction as such since the connection of the screening cone to the supporting frame takes place only after the mutual relationship between the color selection electrode and the luminescent regions provided on the display screen is accurately established. Any subsequent operation in the colour selection electrode may disturb said mutual relationship, which may give rise to color defects in the displayed picture. In the case of a construction without a supporting frame the connection of the screening cone presents problems in particular because the color selection electrode itself has insufficient rigidity for that purpose.

It is the object of the invention to provide a solution to the said problem.

According to the invention, in a cathode-ray tube of the kind mentioned in the preamble the screening cone is connected at its wide end to the clamping members so as to be mechanically decoupled from the color selection electrode.

According to the invention, the screening cone is preferably connected to the said clamping members so as to be detachable by means of a locked coupling.

According to a favourable embodiment of the invention, said detachable connection comprises a locked coupling between projections proceeding from the clamping members and apertures provided in a flange which is present at the wide end of the screening cone and extends substantially parallel to the color selection electrode.

According to a further favourable embodiment according to the invention the screening cone bears at its wide end on the clamping members and is fixed in said position by means of at least two tensioning springs which are stretched between connection points on the screening cone and the clamping members.

It is to be noted that German Pat. No. 2,033,558 describes a color television display tube in which the magnetic screening cone is also detachably secured. According to a construction described in said specification the screening cone is connected to the supporting frame of the color selection electrode by means of clamping springs. The screening cone is not kinetically decoupled from the color selection electrode. According to another embodiment described in said Patent Specification the screening cone is secured to pins which are inserted in the tube wall. However, the insertion of pins in the tube wall is an expensive operation in which a certain reject percentage is inevitable.

Since the screening cone is mechanically decoupled from the color selection electrode, a gap is present between said components through which a small magnetic leakage can arise. In order to avoid this, the screening cone comprises at least between the supporting points a color which overlaps the upright edge of the colour selection electrode at least partly.

Figure 2:
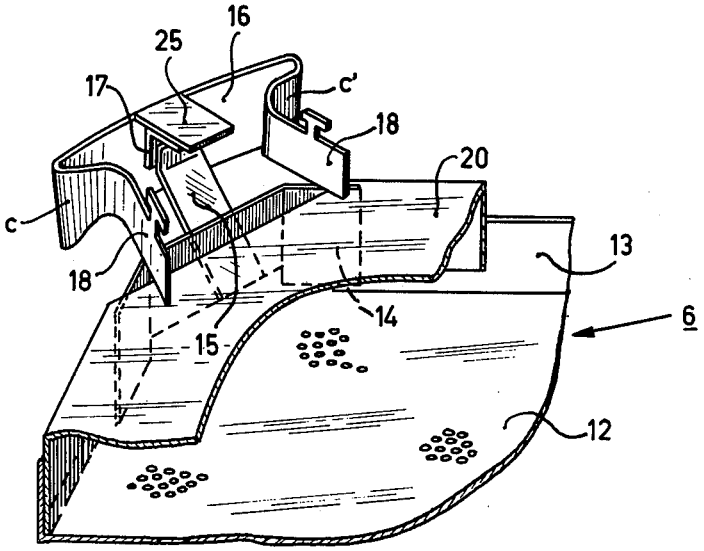
Figure 3:
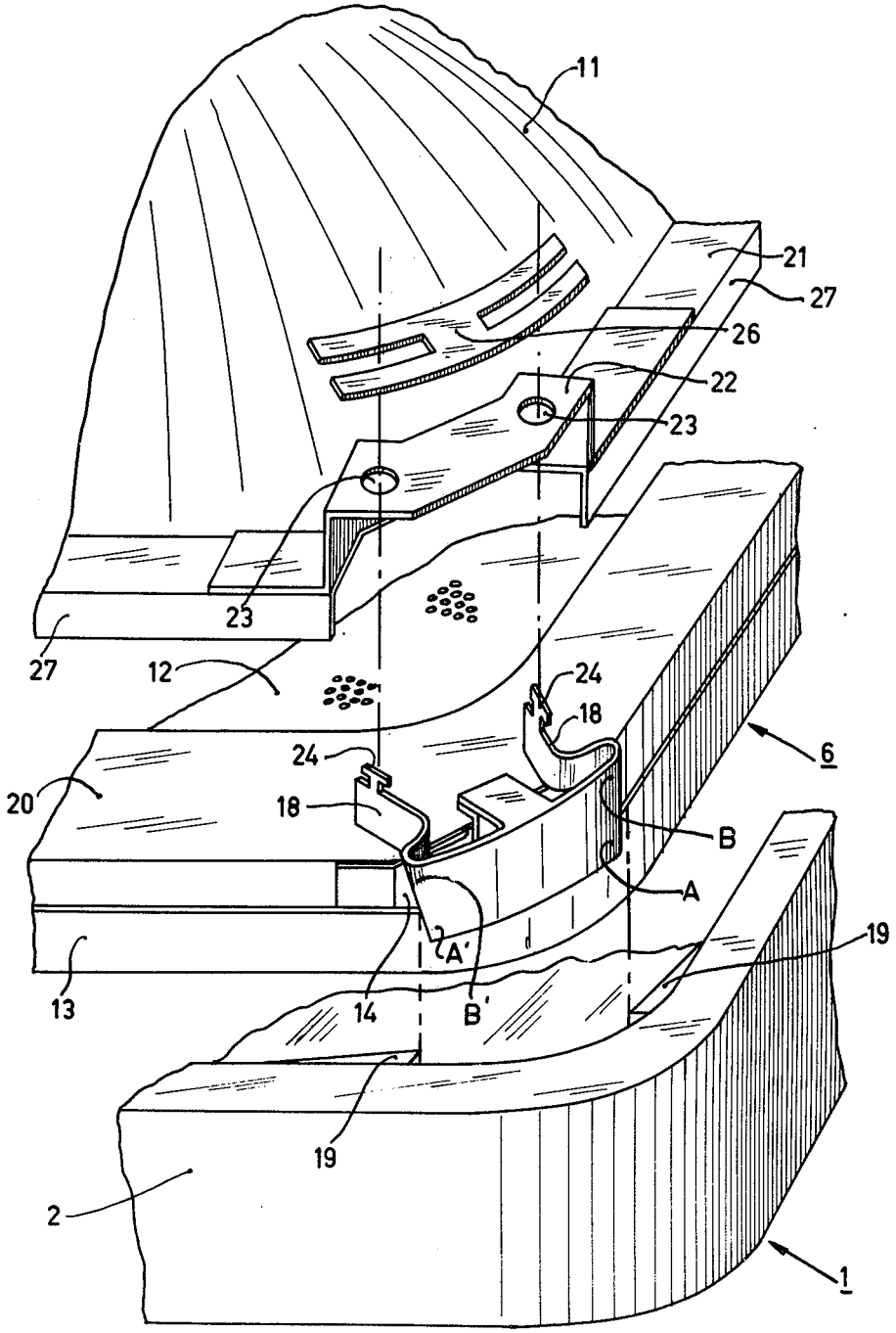

The invention will be described in greater detail with reference to the drawing, in which FIG. 1 shows a partly broken away cathode-ray tube for displaying color pictures according to the invention, FIG. 2 is a perspective drawing of an angle piece of the color selection electrode of the tube shown in FIG. 1, and FIG. 3 is an exploded view of an embodiment of a connection of the screening cone according to the invention.

The evacuated envelope of the cathode-ray tube according to the invention shown in FIG. 1 consists of a rectangular cup-shaped glass window 1, a conical central part 3 and a glass neck 4. In the corners in the upright edge 2 of the window there is a recess 5 to support a color selection electrode 6 suspended at a short distance from the display screen. The tube furthermore comprises an electrode system 7 for generating three electron beams R, G and B which is mounted in the neck and is shown diagrammatically in the drawing. Said three beams are deflected by means of a system 8 of deflection coils placed coaxially around the tube axis, and the beams intersect each other substantially at the area of the color selection electrode 6 after which they impinge upon a mosaic pattern 9 of phosphors luminescing in the color red, green and blue which are provided internally on the display screen 10 in such manner that each of the electron beams is associated with phosphor regions of one color. The electron beams are screened from the earth's magnetic field by means of a metal screening cap 11 extending in the conical central portion.

As shown in FIGS. 2 and 3, the color selection electrode 6 consists of a thin perforated plate 12 having an upright edge 13 which is reinforced in the corners by means of a supporting strip 14. A stripshaped suspension member 15 forming one assembly with said supporting strip is secured to a clamping member 16 via an angular member 17. Said clamping member consists mainly of a metal strip which is bent on either side of the centre and changes into two tensioning arms 18 by means of which it can be inserted in the pretensioned condition between the thickenings 19 in the upright edge 2 of the display screen. When the clamping member has thus been put in its place, it engages, in the points denoted in the Figures by C, C′ and A, B, A′, B′, the walls of the thickenings 19 and the upright edge 2, respectively. A good definition of said points is obtained by providing the clamping member with rounded cams at said sites. Said cams for the glass wall may be covered with a layer of aluminium so as to protect the glass wall.

After adjusting the color selection electrode 16 in the cup-shaped window, the limb of the angular piece 17 extending in a radial direction with respect to the tube axis is welded to the projection 25 of the clamping member 16, while the suspension member 15 is welded to the limb of the said angular piece extending in the axial direction in such manner that the correct position of the clamping member is fixed relative to the color selection electrode. The suspension member 15 is substantially at right angles to the electron beams deflected towards the corner in question, so that a correcting displacement of the color selection electrode in the direction towards the display screen is obtained in a simple manner in the case of a thermal expansion thereof.

The usual rigid supporting frame for the color selection electrode has been replaced by a diaphragm 20 consisting of a ring which has an L-shaped cross-section. Said diaphragm serves to screen electron beams which are deflected over too large angles. In order to avoid temperature differences as well as differences in expansion between the color selection electrode and the diaphragm during heating the tube, both are manufactured from the same metal, while the thickness of the diaphragm is substantially equal to the thickness of the perforated plate 12, namely approximately 150 $\mu$m. The result is a construction which is lighter by approximately a factor 5 to 10 than that in which a rigid supporting frame is used. It is just because of said light construction that it is necessary, however, for the magnetic screening cap to be mounted in the tube while being mechanically decoupled from the color selection electrode. An embodiment of such a connection is shown in FIG. 3. Said Figure again shows the color selection electrode 6 and the suspension mechanism secured thereto as it is shown in FIG. 2, this time, however, viewed from a position rotated through 180° relative to that in FIG. 2.

The conical screening cap 11 has at its wide end a flange 21. The flange is interrupted in the corners by an angular piece 22 having two apertures 23. In the assembled condition of the screening cap 11 the angular piece 22 bears on the tensioning members 18 of the clamping member 16. The T-shaped projections 24 projecting from the tensioning members extend through the apertures 23 and co-operate with an H-shaped locking spring 26. In the assembled condition the flange 21 does not contact the diaphragm 20, while the gap between the flange 21 and the diaphragm 20 is covered by a collar 27 present at the wide end of the screening cone.

Instead of the connection of an H-shaped locking spring it is also possible to cause the screening cone to bear on the clamping members and to maintain it in said position by means of at least two and preferably four tensioning springs which at one end hook behind the edge of the narrow end of the screening cone and at the other end hook behind a clamping member.

What is claimed is:

1. A color cathode-ray tube comprising: an evacuated envelope and, within said envelope, means to generate at least two electron beams; a color selection electrode including an apertured mask and a screening diaphragm having an opening above a central part of said mask and a side wall attached to the edge of the mask, said mask and said diaphragm being made, respectively, of a thin sheet metal; supporting means comprising a plurality of suspension members connected to said electrode and each having a projecting end portion, and a plurality of resilient clamping members connected, respectively, to the projecting end portions to provide a detachable clamping connection with a matching inner portion of said envelope; and a screening cone of ferromagnetic sheet metal for shielding the electron beams from magnetic fields, said cone being secured to said clamping members and spaced from said electrode.

2. A cathode-ray tube as claimed in claim 1, wherein the clamping members are provided with inwardly projecting arms each having a locking T-shaped projection, and said screening cone having near its wide end a flange with opening for receiving said T-shaped projections, thereby forming a detachable coupling between said cone and said clamping members.

3. A cathode-ray tube as claimed in claim 2, wherein the screening cone bears at its wide end on the said clamping members and is fixed in this position by means of at least two tensioning leaf springs which are inserted between connection points of the screening cone and the said projections.

4. A cathode-ray tube as claimed in claim 1, wherein the screening cone comprises at its wide end a collar which overlaps the upright edge of the color selection electrode at least partly.

5. A cathode-ray tube as claimed in claim 1, wherein the suspension members are secured to the corners of the colour selection electrode.

* * * * *